US006173795B1

(12) United States Patent
McGarian et al.

(10) Patent No.: US 6,173,795 B1
(45) Date of Patent: Jan. 16, 2001

(54) MULTI-CYCLE CIRCULATING SUB

(75) Inventors: Bruce McGarian; Lawrence Robert Barr, both of Aberdeen (GB)

(73) Assignee: Smith International, Inc., Houston, TX (US)

( * ) Notice: Under 35 U.S.C. 154(b), the term of this patent shall be extended for 0 days.

(21) Appl. No.: 09/202,214

(22) PCT Filed: Jun. 11, 1997

(86) PCT No.: PCT/GB97/01581

§ 371 Date: Dec. 10, 1998

§ 102(e) Date: Dec. 10, 1998

(87) PCT Pub. No.: WO97/47850

PCT Pub. Date: Dec. 18, 1997

(30) Foreign Application Priority Data

Jun. 11, 1996 (GB) ..... 9612144
Jun. 26, 1996 (GB) ..... 9613356

(51) Int. Cl.[7] ..... E21B 34/00; E21B 34/06; E21B 34/08; E21B 34/10; E21B 34/12

(52) U.S. Cl. ..... 175/231; 166/321; 166/323

(58) Field of Search ..... 166/321, 323, 166/222, 311, 312, 374, 231

(56) References Cited

U.S. PATENT DOCUMENTS 2,921,601 * 1/1960 Fisher, Jr. ..... 166/321
3,823,773 * 7/1974 Nutter ..... 166/321
4,294,314 * 10/1981 Miyagishima et al. ..... 166/321
4,407,377 * 10/1983 Russell ..... 166/321
4,645,006 * 2/1987 Tinsley ..... 166/374
4,657,082 * 4/1987 Ringgenberg ..... 166/321
4,817,723 * 4/1989 Ringgenberg ..... 166/323
5,609,178 * 3/1997 Hennig et al. ..... 137/10
5,890,540 * 4/1999 Pia et al. ..... 166/321

* cited by examiner

*Primary Examiner*—Paul N. Dickson
*Assistant Examiner*—Joselynn Silteris
(74) *Attorney, Agent, or Firm*—Dykema Gossett PLLC

(57) ABSTRACT

A multi-cycle circulating sub apparatus having a control member for controlling the movement of a sleeve between a first or closed position and a second or open position. The control member is slidably mounted in a body and is moveable by fluid pressure in the body in a first axial direction relative to the body. The control member also has a spring biasing the control member in an opposite axial direction of the body. A pin is secured to either the body or the control member. A central groove, in which a portion of the pin is received, is formed in the other of the body or control member. The central groove is shaped to limit axial displacement of the control member in response to pressure variations in the body such that only after a predetermined number of movements of the control member to a first limit position is the control member able to move to a second limit position to displace the sleeve into the second position. The apparatus may also be reset many times while remaining in a downhole position.

17 Claims, 3 Drawing Sheets

MULTI-CYCLE CIRCULATING SUB

The invention relates to circulating subs for use in wellbores, particularly but not exclusively to circulating subs used during downhole drilling operations.

It is often necessary in downhole drilling operations to bleed the flow of wellbore fluid down the drill string into the wellbore annulus. For example, this may be necessary where the desired fluid flow rate to drive a drilling tool is insufficient to carry all the drilled material up the annulus to the surface. In these circumstances, a circulating sub may be used to allow the flow rate required to remove the drilled material to be pumped into the annulus whilst maintaining the lower flow rate required at the drilling tool.

Conventional circulating subs may be moved between an open configuration, in which fluid may bleed to the wellbore annulus, and a closed configuration, in which fluid is prevented from flowing to the annulus, through the use of a PBL sub. When the circulating sub is to be activated, a deformable plastics drop ball is introduced into the drill string and carried downhole to a ball seat by the action of fluid flow and/or gravity. Once the drop ball is received by the ball seat, pump pressure generates a static pressure differential which is employed to move the circulating sub to the open configuration. If the closed configuration is then required, the drop ball may be forced past the seat with additional pump pressure and retained in a catcher adapted to allow the passage of fluid. The circulating sub then returns to its initial configuration by means of a biasing spring. However, this type of circulating sub can prevent the use of wireline or coil tubing tools (since the drop ball substantially blocks the bore through the string) and can be unreliable or inconvenient to use. Furthermore, such circulating subs may only be reset once whilst located downhole. If the circulating sub is to be reset for a second time, then the sub must be withdrawn from the wellbore and the first drop ball manually removed from the catcher.

It is an object of the present invention to provide a circulating sub which is reliable, convenient to use and capable of being reset many times whilst remaining downhole. It is also an object of the present invention to provide a circulating sub which allows the passage of tools therethrough and is thereby compatible with the use of wireline or coil tubing tools.

The present invention provides a multi-cycle circulating sub for selectively providing fluid communication between the interior of a downhole assembly and the exterior thereof, the multi-cycle circulating sub comprising: a body incorporating a wall provided with at least one aperture extending therethrough; a sleeve having a longitudinal bore extending therethrough and being slidably mounted in the body so as to be moveable between a first position relative to the body preventing fluid communication between the bore of the sleeve and the exterior of the body via the or each aperture and a second position relative to the body permitting fluid communication between the bore of the sleeve and the exterior of the body via the or each aperture; and controlling means for controlling the movement of the sleeve between the first and second positions; the controlling means comprising: a control member slidable in the body and moveable by fluid pressure in the body in a first axial direction relative to the body; a spring biasing the control member in an opposite axial direction of the body; a pin secured to one of the body and the control member; and a control groove in which a portion of the pin is received formed in the other of the body and the control member, the control groove being shaped to limit axial displacement of the control member in response to pressure variations in the body such that only after a predetermined number of movements of the control member to a first limit position is the control member able to move to a second limit position to displace the sleeve into the second position of the sleeve.

Preferably, the control member is a piston which is moveable in the body independently of the sleeve. The location of the piston in the body may be such that the piston moves towards the sleeve when axially displaced in the first axial direction relative to the body. Furthermore, the piston is preferably located relative to the sleeve so as to abut and press the sleeve when moving to the second limit position. A guide pin may be secured to one of the body and the sleeve which is received in a guide slot formed in the other of the body and the sleeve, the guide slot extending in a direction parallel to the direction of axial movement of the sleeve so as to prevent rotation of the sleeve. The sleeve is preferably biased towards the first position by means of a spring.

The control member preferably comprises a longitudinal bore extending therethrough. Also, the control groove preferably is provided in a direction having one component parallel to the direction of axial movement of the control member. It is further preferable for the control groove to encircle the longitudinal axis of the control member. The control groove may also provide at least one extension portion extending in a direction having one component parallel to the direction of axial movement of the control member so as to enable the control member to move to the second limit position. Preferably, the control groove is provided on the control member and the pin is secured to the body.

The sleeve may also incorporate a wall provided with at least one opening extending therethrough such that, in the first position the or each opening of the sleeve is offset from the or each aperture of the body so as to prevent the passage of fluid through the or each opening and the or each aperture, and in the second position the or each opening of the sleeve is in register with the or each aperture of the body so as to permit the passage of fluid through the or each opening and the or each aperture.

A bearing is preferably provided between the control member and the spring biasing the control member. A chamber may also be defined between a portion of the control member and a portion of the body, and the spring biasing the control member may be located therein.

The present invention has the advantage over the prior art of being reliable and convenient to use. The circulating sub of the present invention may also be used in conjunction with wireline or coil tubing tools.

An embodiment of the present invention will now be described with reference to the accompanying drawings, in which.

Figure 1:
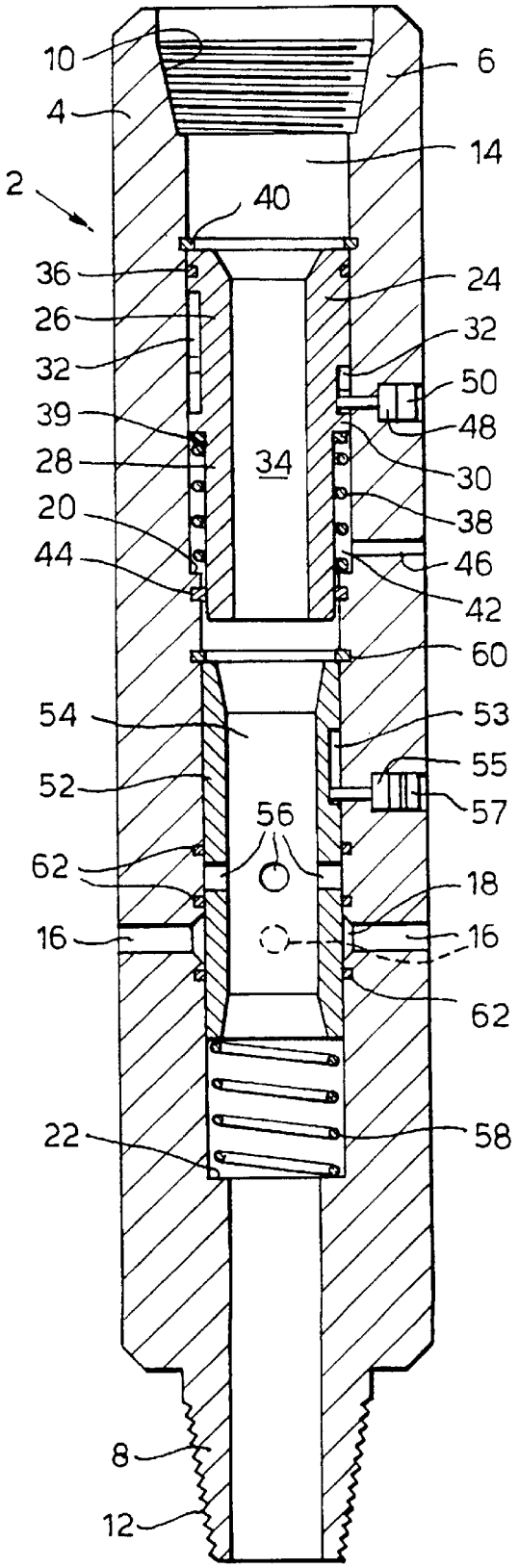
FIG. 1 is a cross-sectional side view of the present invention arranged in a closed configuration with the sleeve located in the first position.
Figure 2:
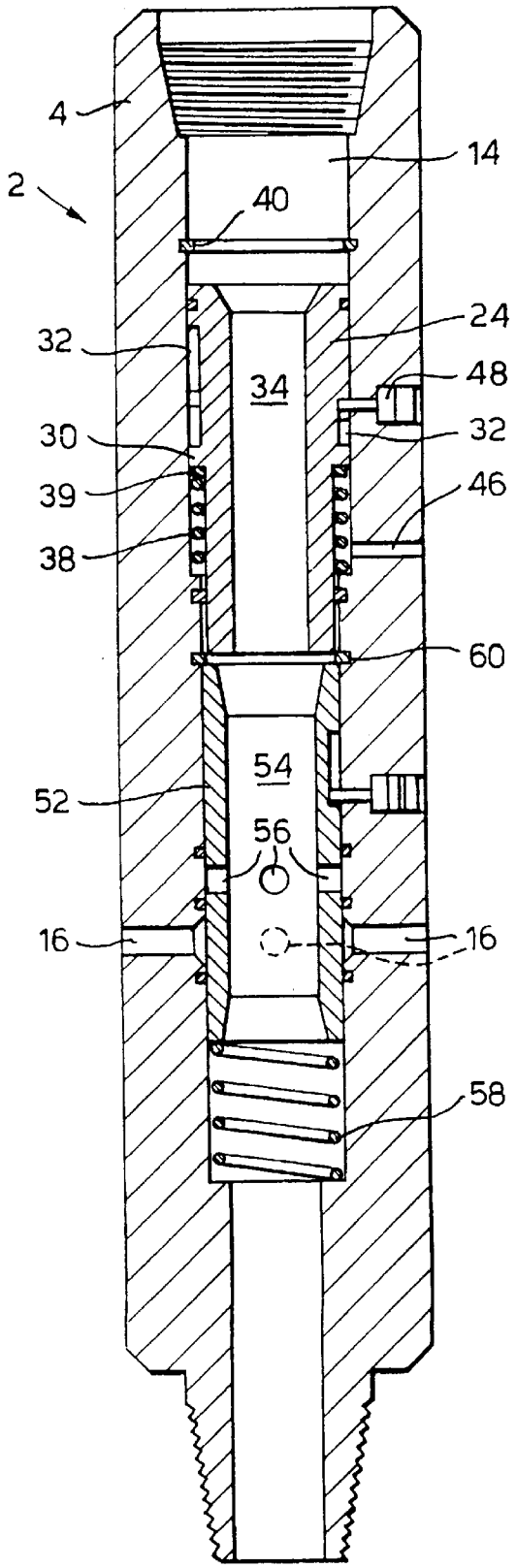
FIG. 2 is a cross-sectional side view of the apparatus of FIG. 1 arranged in a closed configuration with the piston prevented from moving into abutment with the sleeve by the control groove and pin.
Figure 3:
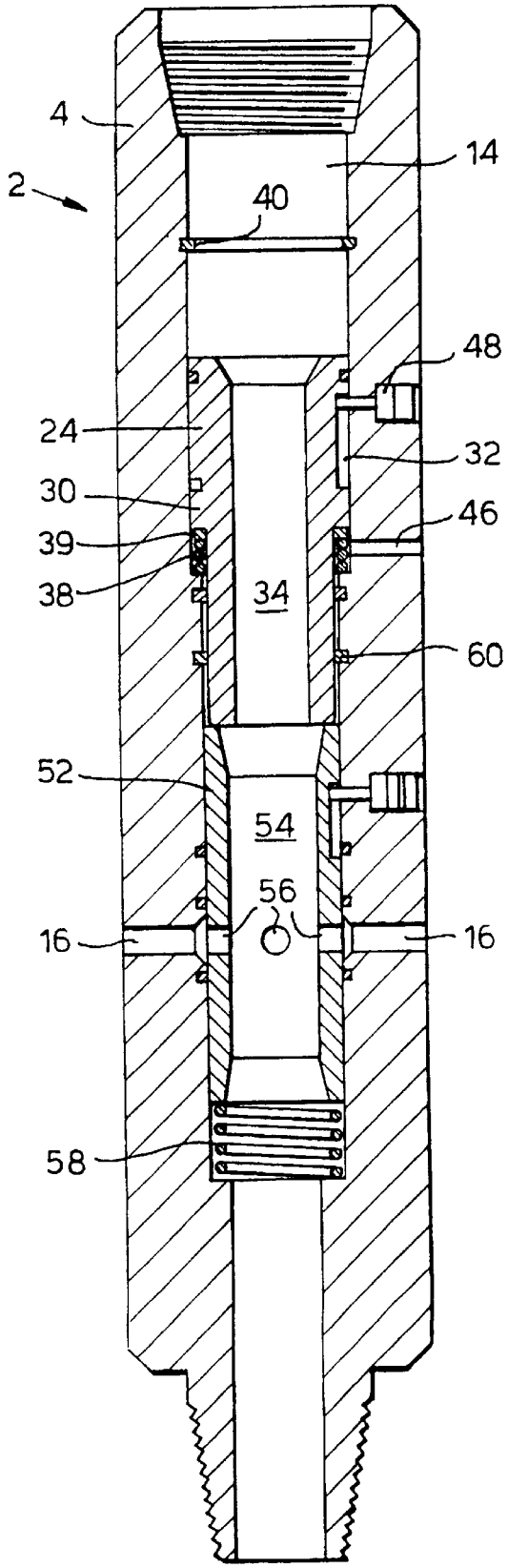
FIG. 3 is a cross-sectional side view of the apparatus of FIG. 1 arranged in an open configuration with the sleeve located in the second position.

The embodiment of FIGS. 1, 2 and 3 is a multi-cycle circulating sub 2 defined by a plurality of internal parts mounted within a substantially cylindrical body 4. The upper and lower ends 6,8 of the body 4 are provided with internal and external screw threads 10, 12 respectively to facilitate attachment of the circulating sub 2 to adjacent components of a downhole string. The body 4 is provided with a bore 14 and a multiplicity of apertures 16 extending radially through the wall thereof so as to allow fluid communication between the bore 14 and the exterior of the circulating sub 2. The apertures 16 lie in a single plane orientated perpendicularly to the longitudinal axis of the body 4. The surface of the bore 14 surrounding the apertures 16 is relieved so as to form a circumferential recess 18. The bore 14 is further provided with a piston spring shoulder 20 and a sleeve spring shoulder 22 upon which internal parts of the circulating sub 2 are mounted.

Figure 2A:
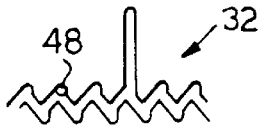
FIG. 2A is a plan view of the unwrapped profile of the control groove located relative to the control pin as shown in FIG. 2.
Figure 3A:
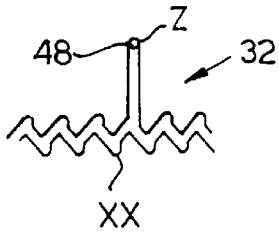
FIG. 3A is a plan view of the unwrapped profile of the control groove located relative to the control pin as shown in FIG. 3.

A piston 24 is slidably located in an upper portion of the bore 14 of the body 4. The piston 24 has a generally cylindrical shape with the upper part 26 thereof having a greater outer diameter than the lower part 28. The difference in diameter between the upper and lower parts 26,28 of the piston 24 provides a piston shoulder 30. The external surface of the upper part 26 is circumscribed by a control groove 32 having the unwrapped profile shown in FIGS. 1A, 2A and 3A. The control groove 32 is provided in a direction having a first component parallel to the direction of axial movement of the piston 24 so as to allow axial movement of the piston 24, and a second component extending circumferentially so as to allow rotation of the piston 24. The control groove 32 is thereby shaped to produce rotary indexing of the piston 24 as the piston 24 moves axially. A seal 36 is provided on the external surface of the piston 24 above the groove 32. The piston 24 is also provided with a bore 34 having a sufficiently large diameter to allow the passage of wire line or coil tubing tools.

The piston 24 is located in the bore 14 with the piston shoulder 30 positioned uphole of the piston spring shoulder 20. A spring 38 extends between the piston spring shoulder 20 and the piston shoulder 30 so as to bias the piston 24 in an uphole axial direction towards the upper end 6 of the body 4. A bearing 39 is located between the spring 38 and the piston shoulder 30 so as to allow the piston 24 to rotate relative to the spring 38 more readily. The uphole displacement of the piston 24 is limited by a retainer 40 positioned in the bore 14 so as to maintain the lower end of the piston 24 below the piston spring shoulder 20. The body 4 and the piston 24 thereby form a piston spring chamber 42 which is sealed by means of the piston seal 36 and a further seal 44 provided on the body 4 below the piston spring shoulder 20. For ease of assembly, the further seal 44 may be provided on the piston 24 rather than the body 4. The axial movement of the piston 24 within the bore 14 is assisted by the provision of a vent hole 46 which, when in use, vents the piston spring chamber 42 to the wellbore annulus. Alternatively, a vent hole may be provided in the piston 24 so as to vent the piston spring chamber 42 to the bore 14.

A control pin 48 extends through the wall of the body 4 so as to project into the bore 14 and locate in the control groove 32. The control pin 48 is secured in position by means of a retaining plug 50. When the piston spring chamber 42 is vented by a vent hole provided in the piston 24, the loss of wellbore fluid through the hole in which the control pin 48 is located is prevented by means of a suitable seal.

A sleeve 52 is slidably located in the bore 14 downhole of the piston 24 in the region of the apertures 16. The sleeve 52 has a cylindrical shape and is provided with a bore 54 having a sufficiently large diameter to allow the passage of wireline or coil tubing tools. The body of the sleeve 52 is provided with a guide slot 53 which extends in a direction parallel to the longitudinal axis of the bore 14. A guide pin 55 projects into the guide slot 53 from a hole in the body 4 and thereby prevents the sleeve 52 and the body 4 from rotating relative to one another. A guide pin retainer and seal 57 ensure that the guide pin 55 remains in position and prevents the loss of wellbore fluid through the hole in which the pin 55 is located. The body of the sleeve 52 is also provided with a plurality of flow ports 56 which, when in use, allow fluid communication between the bore 54 and the apertures 16. The circumferential recess 18 ensures that the bore 54 and the apertures 16 are in fluid communication in circumstances where the flow ports 56 and the apertures 16 are located in the same plane but are circumferentially offset relative to each other. However, the sleeve 52 is preferably arranged relative to the body 4 so that the flow ports 56 and the apertures 16 align when coplanar. This arrangement is maintained by means of the guide slot 53 and the guide pin 55.

The sleeve 52 is supported by a spring 58 which reacts against the sleeve spring shoulder 22 and presses the sleeve 52 against a retainer 60 mounted in the bore 14 below the piston 24. The sleeve 52 is thereby located in a first position in which the flow ports 56 are axially offset from the apertures 16. Seals 62 are provided in the bore 14 adjacent the sleeve 52 so as to prevent the flow of fluid from the bores 14,54 of the body 4 and the sleeve 52 respectively through the flow ports 56 or the apertures 16. The seals 62 may be alternatively provided on the sleeve 52 rather than the body 4 so as to allow the sub 2 to be assembled more readily. The outer diameter of the lower part 28 of the piston 24 is less than the outer diameter of the sleeve 52 so that the lower part 28 may move axially past the sleeve retainer 60 and press against the sleeve 52. The piston 24 may thereby axially displace the sleeve 52 against the bias of the sleeve spring 58 to a position in which the flow ports 56 are substantially coplanar with the apertures 16. In this second position, the sleeve 52 permits fluid communication between the bore 54 and the wellbore annulus.

In order to prevent the sleeve 52 from oscillating between the first and second positions as a result of axial vibration of the sub 2 during a drilling operation or as a result of fluid surge within the downhole string, the sleeve spring 58 is selected to have a relatively high stiffness and sufficient length to ensure that the spring is partially compressed when the sleeve 52 is in the first position. The sleeve 52 is thereby forcibly pressed against the sleeve retainer 60 and undesirable leakage of fluid through the fluid ports 56 and the apertures 16 is avoided. The affect of fluid surge on the sleeve 52 is also reduced by manufacturing the sleeve 52 from a material having a relatively low mass and by providing the sleeve 52 with a bore 54 having a large diameter. The large diameter ensures that the walls of the sleeve 52 are relatively thin, that the pressure differential across the length of the sleeve 52 is relatively small and that the weight of the sleeve 52 is low.

Figure 1A:
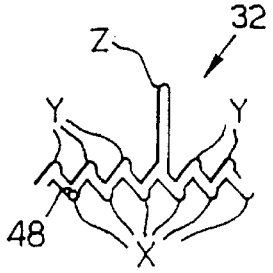
FIG. 1A is a plan view of the unwrapped profile of the control groove located relative to the control pin as shown in FIG. 1.

When in use, the multi-cycle circulating sub 2 forms part of a downhole string through which wellbore fluid may be pumped in order to operate equipment such as an anchor packer or a drilling tool, for example, a turbo drill or a positive displacement motor. FIGS. 1 and 1A show the circulating sub 2 arranged with the piston 24 located in an inactivated position. In this inactivated position, the piston 24 is located in abutment with the piston retainer 40, the lower end of the piston 24 is spaced from the upper end of the sleeve 52, and the control pin 48 is located at one of six inactivated groove positions X within the control groove 32. The piston 24 will remain in the inactivated position until a predetermined pressure differential across the length of the piston 24 is generated either by the application of dynamic pressure (due to a flow of wellbore fluid through the circulating sub 2) or static pressure. The pressure differential across the length of the piston 24 will be typically varied by adjustments in the rate of flow of wellbore fluid down the downhole string, and once the predetermined pressure differential is generated or exceeded, the piston 24 will attempt to move to the activated position shown in FIGS. 3 and 3A.

However, the axial movement of the piston 24 is controlled by the interaction of the control pin 48 and the control groove 32, and the piston 24 will be prevented from moving to the activated position unless the control pin 48 is located at position XX within the control groove 32 (see FIG. 3A) immediately before the predetermined pressure differential is produced. If the control pin 48 is not located at position XX, then the axial movement of the piston 24 will be limited by the abutment of the control pin 48 against the side of the control groove 32 at one of five intermediate groove positions Y (see FIG. 1A). Although displaced axially, the piston 24 remains spaced from the sleeve 52 when the control pin 48 is located at any one of the intermediate groove positions Y (see FIGS. 2 and 2A). With the piston 24 located in either of the inactivated or intermediate positions shown in FIGS. 1 and 2 respectively, the sleeve 52 remains in its first position and prevents the discharge of wellbore fluid from the downhole string through the apertures 16.

When the control pin 48 is located in position XX within the control groove 32 immediately before the predetermined pressure differential is generated or exceeded, the profile of the control groove 32 allows the piston 24 to move axially into abutment with the sleeve 52, and furthermore, to move the sleeve 52 into the second position so as to allow the discharge of wellbore fluid from the string through the apertures 16. As the piston 24 moves downhole relative to the body 4, the control pin 48 moves within the control groove 32 from position XX to an activated groove position Z. In order for the piston 24 to press the sleeve 52 into the second position (rather than merely move into abutment with the sleeve 52), the pressure differential across the piston 24 and the sleeve 52 must be sufficient to overcome the bias of both the piston spring 38 and the sleeve spring 58. In practice, when the sleeve 52 moves into the second position and fluid begins to discharge through the apertures 16, the pressure differential across the piston 24 and the sleeve 52 drops. In order to prevent the sleeve 52 from returning to its first position prematurely, it may then be necessary to increase the rate of flow of wellbore fluid down the string.

The multi-cycle circulating sub 2 thereby allows the apertures 16 to be selectively opened in order to bleed wellbore fluid from a downhole string. When bleeding of wellbore fluid is required, the rate of flow of wellbore fluid down the string is varied so as to vary the pressure differential across the piston 24 and thereby cycle the control pin 48 along the control groove 32 until the control pin 48 locates in the position XX. The rate of flow of wellbore fluid through the string is then increased as necessary so as to overcome the bias of the springs 38,58 and move the sleeve 52 into the second position (i.e. the open position). If the bleeding of wellbore fluid is not required when the sleeve 52 is in the second position, then the rate of flow of fluid down the string may be varied so as to cycle the control pin 48 to an inactivated groove position X not being position XX. The circulating sub 2 may then pass fluid at high flow rates without the sleeve 52 moving into the second position and opening the apertures 16.

The present invention is not limited to the specific embodiment described above. Variations and alterations will be apparent to the reader skilled in the art. For example, the control groove 32 may have an alternative profile with a different number of inactivated, intermediate and activated groove positions. The control groove 32 shown in FIGS. 1A, 2A and 3A has a profile which causes the piston 24 to rotate through 30° when moving axially between the successive axial limit positions (inactivated, intermediate or activated). The profile may be altered so that the piston 24 rotates through a different angle when moving between axial limit positions. Furthermore, a stop arrangement may be provided which limits the downhole axial movement of the sleeve 52 and the piston 24 so as to prevent the control pin 48 from being damaged against the side of the control groove 32 at the activated groove position Z.

A pressure blow-out device (for example, a burst disc) may also be provided integrally with the circulating sub 2 below the sleeve spring shoulder 22. Consequently, if the flow of wellbore fluid in the portion of the string located below the circulating sub 2 is prevented, then a flow of fluid through the circulating sub 2 may be generated by activating the pressure blow-out device. However, the venting of the piston spring chamber 42 to the annulus allows static pressure in the bore 14 to generate a resultant force on the piston 24 which acts against the spring bias. It is therefore possible to open the apertures 16 without a flow of fluid down the string. Also, in order to increase the force with which the sleeve 52 presses against the sleeve retainer 60 (thereby reducing the affects of fluid surge and axial vibration), the sleeve 52 may be arranged within the bore 14 in a similar manner to the piston 24 so as to generate a resultant force due to static pressure acting in an axial uphole direction. This force must also be overcome when moving the sleeve 52 into the second position. Furthermore, provision may be made on the upper end of the piston 24 for receiving a nozzle. The flow rate required to axially move the piston 24 may be then selected with the attachment of an appropriate nozzle to the piston 24.

The circulating sub of the present invention may also be provided with the sleeve 52 integral with the piston 24. In this case, the guide pin 55 and guide slot 53 are not provided since the sleeve 52 must be able to rotate with the piston 24 relative to the body 4. Furthermore, the sleeve retainer 60 and the sleeve spring 58 may be omitted since their functions may be performed by the piston retainer 40 and the piston spring 38 respectively. However, when the sleeve seals 62 are provided on the body 4, the spacing between the upper pair of seals 62 must be sufficient to allow the flow ports 56 to move axially without fluid leakage as the piston 24 moves axially between inactivated and intermediate positions.

What is claimed is:

1. A multi-cycle circulating sub for selectively providing fluid communication between the interior of a downhole assembly and the exterior thereof, the multi-cycle circulating sub comprising:

a body incorporating a wall provided with at least one aperture extending therethrough;

a sleeve having a longitudinal bore extending therethrough and being slidably mounted in the body so as to be moveable between a first position relative to the body preventing fluid communication between the bore of the sleeve and the exterior of the body via the or each aperture and a second position relative to the body permitting fluid communication between the bore of the sleeve and the exterior of the body via the or each aperture; and controlling means for controlling the movement of the sleeve between the first and second positions;

the controlling means comprising:

a control member slidable in the body and moveable by fluid pressure in the body in a first axial direction relative to the body;

a spring biasing the control member in an opposite axial direction of the body; a pin secured to one of the body and the control member; and a control groove formed in the other of the body and the control member, the control groove receiving a portion of the pin and being shaped to limit axial displacement of the control member in response to pressure variations in the body such that only after a predetermined number of movements of the control member to a first limit position is the control member able to move to a second limit position to displace the sleeve into the second position of the sleeve;

wherein the control member is moveable in the body independently of the sleeve.

2. A multi-cycle circulating sub as claimed in claim 1, wherein the control member is a piston.

3. A multi-cycle circulating sub as claimed in claim 2, wherein the location of the control member in the body is such that the control member moves towards the sleeve when axially displaced in the first axial direction relative to the body.

4. A multi-cycle circulating sub as claimed in claim 2, wherein the control member is located relative to the sleeve so as to abut and press the sleeve when moving to the second limit position.

5. A multi-cycle circulating sub as claimed in claim 2, wherein a guide pin secured to one of the body and the sleeve is received in a guide slot formed in the other of the body and the sleeve, the guide slot extending in a direction parallel to the direction of axial movement of the sleeve so as to prevent rotation of the sleeve.

6. A multi-cycle circulating sub as claimed in claim 2, wherein the sleeve is biased towards the first position by means of a spring.

7. A multi-cycle circulating sub as claimed in claim 1, wherein the control member comprises a longitudinal bore extending therethrough.

8. A multi-cycle circulating sub as claimed in claim 1, wherein the control groove is provided in a direction having one component parallel to the direction of axial movement of the control member.

9. A multi-cycle circulating sub as claimed in claim 1, wherein the control groove encircles the longitudinal axis of the control member.

10. A multi-cycle circulating sub as claimed in claim 1, wherein the control groove provides at least one extension portion extending in a direction having one component parallel to the direction of axial movement of the control member so as to enable the control member to move to the second limit position.

11. A multi-cycle circulating sub as claimed in claim 1, wherein the control groove is provided on the control member and the pin is secured to the body.

12. A multi-cycle circulating sub as claimed in claim 1, wherein the sleeve incorporates a wall provided with at least one opening extending therethrough such that, in the first position the or each opening of the sleeve is offset from the or each aperture of the body so as to prevent the passage of fluid through the or each opening and the or each aperture, and in the second position the or each opening of the sleeve is in register with the or each aperture of the body so as to permit the passage of fluid through the or each opening and the or each aperture.

13. A multi-cycle circulating sub as claimed in claim 1, wherein a bearing is provided between the control member and the spring biasing the control member.

14. A multi-cycle circulating sub as claimed in claim 1, wherein a chamber is defined between a portion of the control member and a portion of the body.

15. A multi-cycle circulating sub as claimed in claim 14, wherein the spring biasing the control member is located in the chamber.

16. A multi-cycle circulating sub as claimed in claim 14, wherein the chamber is vented to the exterior of the body by means of an aperture in the body.

17. A multi-cycle circulating sub as claimed in claim 1, wherein the control groove is shaped to produce rotary indexing of the control member as the control member is moved axially from a rest position to the first limit position and back to the rest position.

* * * * *